US006905027B2

(12) United States Patent
Galter

(10) Patent No.: US 6,905,027 B2
(45) Date of Patent: Jun. 14, 2005

(54) PIVOTABLE DISPLAY CONTAINER

(76) Inventor: Siegfried Galter, Zollernring 20, 89073 Ulm (DE)

( * ) Notice: Subject to any disclaimer, the term of this patent is extended or adjusted under 35 U.S.C. 154(b) by 63 days.

(21) Appl. No.: 10/450,283

(22) PCT Filed: Dec. 19, 2001

(86) PCT No.: PCT/EP01/15066

§ 371 (c)(1),
(2), (4) Date: Jun. 11, 2003

(87) PCT Pub. No.: WO02/051720

PCT Pub. Date: Jul. 4, 2002

(65) Prior Publication Data

US 2004/0041014 A1 Mar. 4, 2004

(30) Foreign Application Priority Data

| | | |
|---|---|---|
| Dec. 27, 2000 | (DE) | 100 65 448 |
| Jan. 12, 2001 | (DE) | 101 01 153 |
| Sep. 8, 2001 | (DE) | 101 44 237 |

(51) Int. Cl.[7] ..... B65D 25/04; B65D 79/00

(52) U.S. Cl. ..... 206/749; 206/278; 206/299; 206/747; 229/120.09; 229/120.12

(58) Field of Search ..... 206/278, 749–750, 206/299, 745–747; 229/117.14, 120.08, 120.09, 120.11, 120.12

(56) References Cited

U.S. PATENT DOCUMENTS

| | | | | |
|---|---|---|---|---|
| 1,065,922 A | * | 7/1913 | Cutler | 206/747 |
| 2,446,366 A | | 8/1948 | Byrd | |
| 3,677,458 A | | 7/1972 | Gosling | |
| 4,256,223 A | | 3/1981 | Pawlowski | |
| 4,917,290 A | | 4/1990 | Saiko et al. | |

FOREIGN PATENT DOCUMENTS

| | | |
|---|---|---|
| DE | 19 92 451 | 8/1968 |
| DE | 90 10 977 | 11/1990 |
| DE | 196 21 281 | 11/1996 |
| DE | 7 915 826 | 8/1999 |
| DE | 199 04 969 | 8/2000 |
| FR | 2 730 699 | 8/1996 |
| GB | 1 152 168 | 5/1969 |

* cited by examiner

*Primary Examiner*—Bryon P. Gehman
(74) *Attorney, Agent, or Firm*—Collard & Roe, P.C.

(57) ABSTRACT

A container is described, in particular a container for keeping and transporting shoes, which can be used in various relative positions of two preferably equal part volumes of the container, at least one of these positions having a form that is striking and particularly suitable for presentation purposes. The container can preferably be folded up from a flat blank.

19 Claims, 7 Drawing Sheets

PIVOTABLE DISPLAY CONTAINER

CROSS REFERENCE TO RELATED APPLICATIONS

Applicants claim priority under 35 U.S.C. §119 of GERMAN Application No. 100 65 448.7 filed on 27 Dec. 2000; GERMAN Application No. 101 01 153.9 filed on 12 Jan. 2001; and GERMAN Application No. 101 44 237.8 filed on 8 Sep. 2001. Applicants also claim priority under 35 U.S.C. §365 of PCT/EP01/15066 filed on 19 Dec. 2001. The international application under PCT article 21(2) was not published in English.

BACKGROUND OF THE INVENTION

1. Field of the Invention

The invention relates to a container having a container volume that can be divided into two part volumes, in particular to hold shoes in pairs.

2. The Prior Art

DE 79 15 826 U1 describes a box-like container for dispatch, storage and sales purposes, in which a cuboid container can be divided into two half shells by a diagonal dividing plane. A similar container, in which the side walls are not exactly rectangular and the dividing plane deviates slightly from the diagonal, is disclosed by DE 298 225 504 U1. U.S. Pat. No. 2,790,542 discloses reassembling the two half shells of a diagonally divided cuboid container at two rectangular longitudinal sides and connecting them via tabs to form a parallelogram-shaped presentation stand.

DE 199 04 969 A1 shows a shoe packing container in the form of a hollow foam block divided into two parts by a dividing plane that is rotated with respect to a diagonal, whose parts in each case hold one shoe of a pair and are connected on one side along the dividing plane by an adhesive tape, so that the two half shells can be pivoted relative to each other about the line bridged by the adhesive tape.

Cuboid containers having two cuboid part volumes which rest on each other along a mid-plane parallel to two cuboid surfaces and can be pivoted with respect to each other about a connecting seam located in the mid-plane are known, for example from FR 27 30 699 A1, U.S. Pat. No. 4,256,223, DE 19 92 451 U1 and U.S. Pat. No. 3,677,458.

DE 90 10 977 U1 shows a single-piece packaging box for shoes, whose cuboid lower part is sealed off by a lid arrangement divided into two, which is subdivided into two half lids by a center line parallel to the edges or a diagonal, the two half lids in each case being connected to the lower part along a cuboid edge and being capable of pivoted about the cuboid edge to be opened.

A container for shoes, disclosed by DE 196 21 281 A1, has, on one side of a cuboid basic body, a lid that can be folded out. A shoe box described in U.S. Pat. No. 4,917,290 in each case holds one of two shoes in two part volumes that can be pivoted relative to each other, both the part volumes and an overall body formed by the latter having a shape that is not cuboid with trapezoidal side surfaces.

SUMMARY OF THE INVENTION

The invention is based on the object of specifying an advantageous, novel container, particularly suitable for pairs of shoes.

The invention is described in the independent patent claim 1. The dependent claims contain advantageous embodiments and developments of the container according to the invention.

The container according to the invention is distinguished by its ability to be used flexibly, the assembled cuboid body again having in the first position of the two part volumes the known advantages of a low space requirement during transport and storage and high stability in the stacked arrangement and being present in the second position in a form which can be used in various alignments, is practical and particularly suitable for stylistic and presentation purposes as a result of its striking character.

By means of the additional supporting element provided by the invention, a further alignment of the container in the second position of the part volumes is advantageously possible, in particular in a straightforward manner, in such a form that the container is set up on a standing surface with one side face of the cuboid form facing the latter. The container preferably stands with the cuboid side flat on the standing surface. In this alignment of the container in the second position, one of the two part volumes, whose cuboid side surface, which in particular is the short cuboid side surface when the dividing surface is led diagonally, determines a standing plane and stands up with the latter on a standing surface, standing stably, whereas the other part volume does not contact the standing surface, or contacts it only with one corner edge, and otherwise extends upward from the standing surface without further support in such a way that the container, under certain circumstances, does not readily remain standing in this arrangement. This other part volume is supported with respect to the standing surface by the further supporting element. The supporting element ends with a supporting point, a supporting edge and/or a supporting surface in the standing plane determined by the side surface of the one part volume facing the standing surface. For this purpose, the supporting element can in particular form a supporting line which, in the standing plane, runs parallel to edges of the cuboid side surface of one part volume standing on the standing surface. Such a supporting element is preferably formed as an extension of the surface of one of the part surfaces of the divided lid surface.

According to a first advantageous embodiment, this extension of the surface can at the same time form a loop which can be pushed through the base surface in the first position of the container in order to carry the container. Another preferred embodiment has such a surface extension of the part surface of the lid surface of a first part volume which, in the first position with the cuboid form of the container, can cover the other part surface of the lid surface of a second part volume and advantageously engage around its cuboid edges by means of an edge fold.

The container can preferably be folded out in a manner known per se from a flat blank and, in the folded-up position, can be stabilized by adhesive bonding or insertion of individual elements. The flat blank results in a particularly low space requirement before the container is folded up. The container can also be constructed from a plurality of separate parts, preferably few separate parts. The obvious cost-effective material for the container is board but, because of the particular shape of the body, in particular in the second position of the part volumes and/or according to a development with a carrying loop in the first position, in order to assist the striking character of the container, other materials, in particular plastic, including transparent plastic, metal, combinations of such materials with one another and/or with textiles and fabrics with high material costs can be justified and appropriate. The container can also consist, entirely or in part surfaces, of textile material, leather etc., which, as a result of its own structure or by means of supporting frames, supporting surfaces or the like, is sufficiently surface dimensionally stable. The material can beneficially also be washable and/or wipeable. This is in particular advantageous for the use of the container for regular use as a portable container, for example as a sports shoe bag.

An advantageous embodiment of the container provides for the container to be able to be returned to the form of the flat blank again without destruction by means of the manner in which its surfaces or part surfaces are connected to form the part volume, and also cto be able toan be brought from the blank into the container form again, for example by means of plug-in connections, snap fastener connections or, in particular, touch and close connections. As a result, outside the times of use, the container is suitable for intermediate storage with a particularly low space requirement.

The container according to the invention is particularly suitable for holding pairs of shoes, the part volumes with approximately triangular part outline being matched particularly beneficially to the basic shape of shoes with a low height in the region of the point of the shoe and, by contrast, a greater height in the heel area, and each of the two preferably equally shaped part volumes accommodating an individual shoe of the pair. Each part volume can be covered separately with respect to the dividing surface, in particular by a dividing surface element that extends the lid surface toward the base surface.

The first and/or the second position of the part volumes can be stabilized by elements belonging to the container, such as tabs that can be folded over and/or inserted into slots, and so on, tabs that can be hooked into each other and which can already be taken into account when shaping a flat blank, but also additional elements such as touch and close fasteners; eyelets and tapes, and so on.

One development provides for plug-in tabs extending the part surfaces of the lid surface along the dividing surface toward the base surface to be able to be plugged through a slot in the base surface and, as handles, to project beyond the base surface, it being possible for the parts projecting beyond the base surface to be designed in particular as loops with a cutout. The cuboid body can then be carried by the handle sections of the plug-in tabs with the base surface pointing upward.

In the second relative position of the part volumes, the container can also be set up with the corners of the side walls remote from the dividing surface on a standing surface and can point upward with the dividing surface. When the part volumes are covered, the dividing surface can serve as a supporting surface, for example for the presentation of shoes. The distance between the corners standing on the standing surface in a direction parallel to the folding line is preferably at least 40% of the length of the dividing surface in the direction of the folding line, so that adequate standing strength of the container in this position is provided. The corners can be designed to be flattened off or rounded.

In the second relative position of the part volumes, the container can also be set up with the dividing surface facing the standing surface and can point upward with the corners of the side surfaces. The upwardly pointing side surfaces, in particular the less steeply aligned side surfaces, can be used as a storage surface, for example for shoes.

The decorative shape and ability of the container to be used flexibly in the second position of the part volumes, in particular the new standing possibility provided by the invention, makes said container attractive to use beyond the function as a storage container and transport container, so that a longer period of use until disposal can be achieved and/or the container can additionally be used as a room-styling element and presentation object.

BRIEF DESCRIPTION OF THE DRAWINGS

The invention is illustrated in more detail below using advantageous exemplary embodiments and with reference to the figures, in which.

DETAILED DESCRIPTION OF THE PREFERRED EMBODIMENTS

Figure 1:
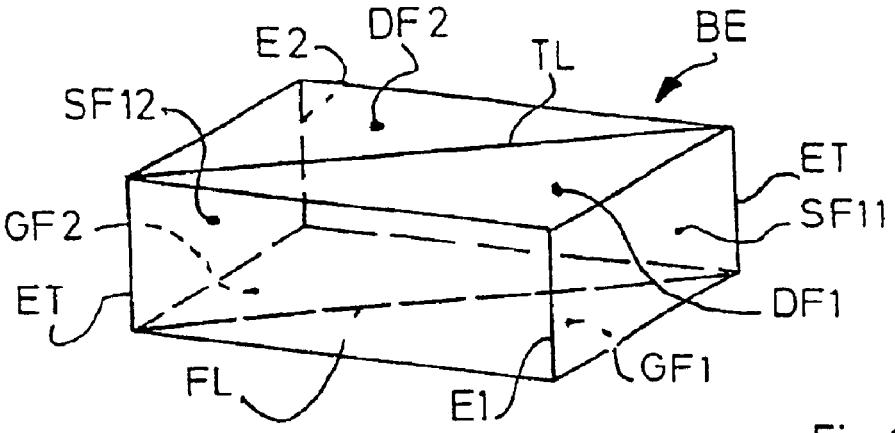
FIG. 1 shows an oblique view of a basic shape of the container according to the invention.
Figure 2:
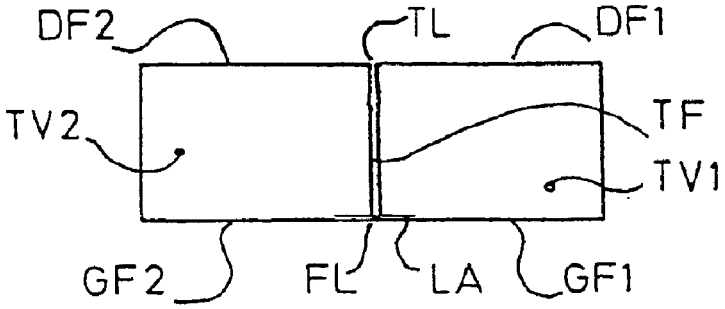
FIG. 2 shows a view related to FIG. 1, parallel to the dividing surface.

FIG. 1 shows, in an oblique view, a simple and preferred basic design of a container according to the invention which, in the first position sketched, forms a cuboid container with a base surface, a lid surface parallel thereto and four side walls, and whose container volume is divided up into two part volumes TV1 and TV2 by a flat dividing surface TF which, with respect to lid surface and base surface, runs diagonally between corner edges ET, which part volumes, in the view according to FIG. 2, with direction of view parallel to the dividing surface TF, as can be seen appear to be divided. The plane of the dividing surface forms with the lid surface a dividing line TL between part surfaces DF1 and DF2 of the lid surface and, with the base surface, a fold line FL between two part surfaces GF1 and GF2 of the base surface.

The part volumes TV1, TV2 can advantageously be closed off separately by respectively dedicated dividing surface elements TF1, TF2, which preferably continue the lid surfaces DF1 and DF2 toward the base surface along bend lines at the dividing line TL. The dividing surface elements can in turn continue in tabs LA, as sketched in FIG. 2, which, in the given example, are inserted parallel to the base surface.

Figure 3:
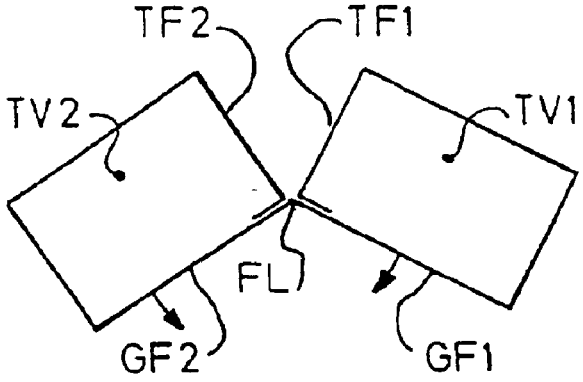
FIG. 3 shows an intermediate position.
Figure 4:
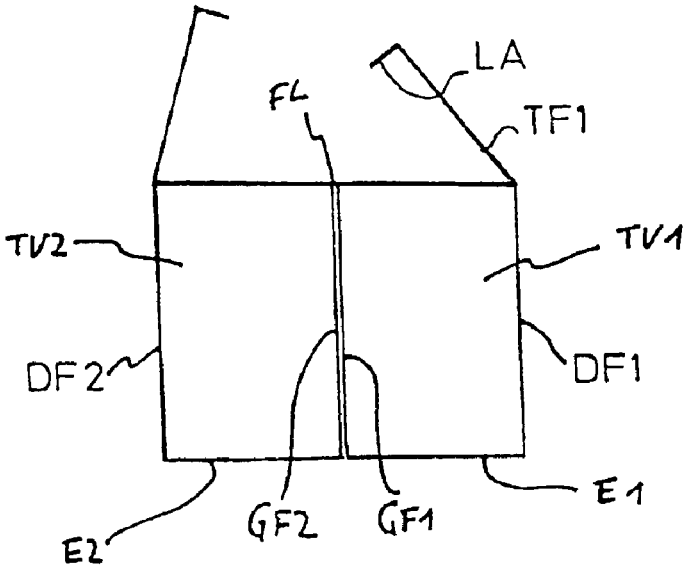
FIG. 4 shows a second end position.

The two part volumes TV1 and TV2 can be divided along the dividing line TL and the corner edges ET and can be pivoted out relative to each other along the fold line from the first position sketched in FIG. 1 and FIG. 2, the dividing surface elements TF1 and TF2 moving away from each other, as illustrated in FIG. 3 by using an intermediate position, and the part surfaces GF1 and GF2 moving toward each other until they are immediately opposite each other in a second position as end position, as sketched in FIG. 4. The part volumes are accessible from above or can be closed separately via the dividing surface elements TF1, TF2, it being possible in the closed state for the dividing surface elements 2 to be supported against being forced further into the part volumes by the tabs LA on the side surfaces, which are now inclined with respect to the vertical. The relative position of the two part volumes of the container in the first position according to FIG. 1 and FIG. 2 and/or in the second position according to FIG. 4 can be stabilized in a form-fitting and/or force-fitting manner by elements of the container not shown in detail.

Figure 5:
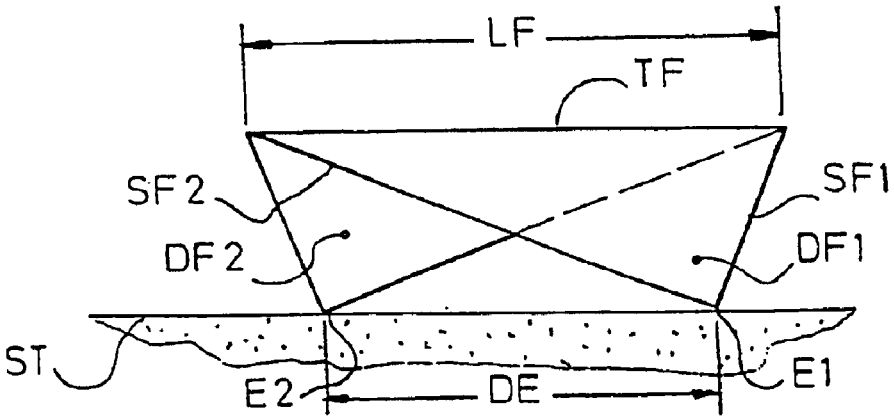
FIG. 5 shows a standing position in side view related to FIG. 4.

FIG. 5 shows a side view of a container of the type of FIG. 4 with different side relationships in the second position with direction of view parallel to the surface normals to the part surfaces of the base surface and the lid surface, and illustrates the partial overlapping of the mutually facing part surfaces GF1, GF2 of the base surface. The container stands with the corner edges E1 and E2 facing away from the dividing surface TF on a standing surface ST and points upward with the dividing surface. With the part volumes closed, the supporting surface elements TF1, TF2 can be used as a storage surface for articles. In particular, in the preferred use of the container as a shoe container, the shoes can be presented on the dividing surfaces, the striking shape of the container acting as an additional eye catcher. For high stability, it is advantageous if the longitudinal distance DE between the upright corner edges E1, E2 is at least 40% of the length LF of the dividing surface pointing upward, in each case parallel to the direction of the fold line FL. The standing attitude of the container sketched in FIG. 5 is known per se from DE 199 04 969 A1 for the hollow foam body described there.

Figure 6:
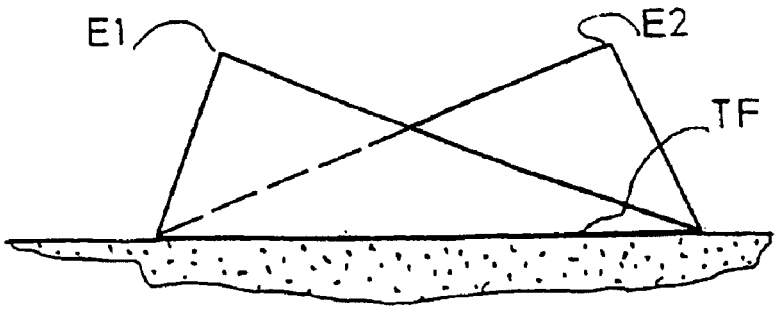
FIG. 6 shows a second standing position.

The container formed in the second position of the part volumes, as sketched in FIG. 6, can also be stood up in a different attitude with a dividing surface pointing toward the standing surface ST and with the corner edges E1, E2 remote from the dividing surface pointing upward. Here too, the result is a striking container form as an eye catcher which, as a result of the changed alignment, presents an apparently completely different form to the viewer than that of FIG. 5, so that the same containers in various positions and alignments offer a plurality of different styling elements. In particular, the upwardly pointing side surfaces inclined less with respect to the horizontal can be used as a standing surface, for example for shoes.

Figure 7:
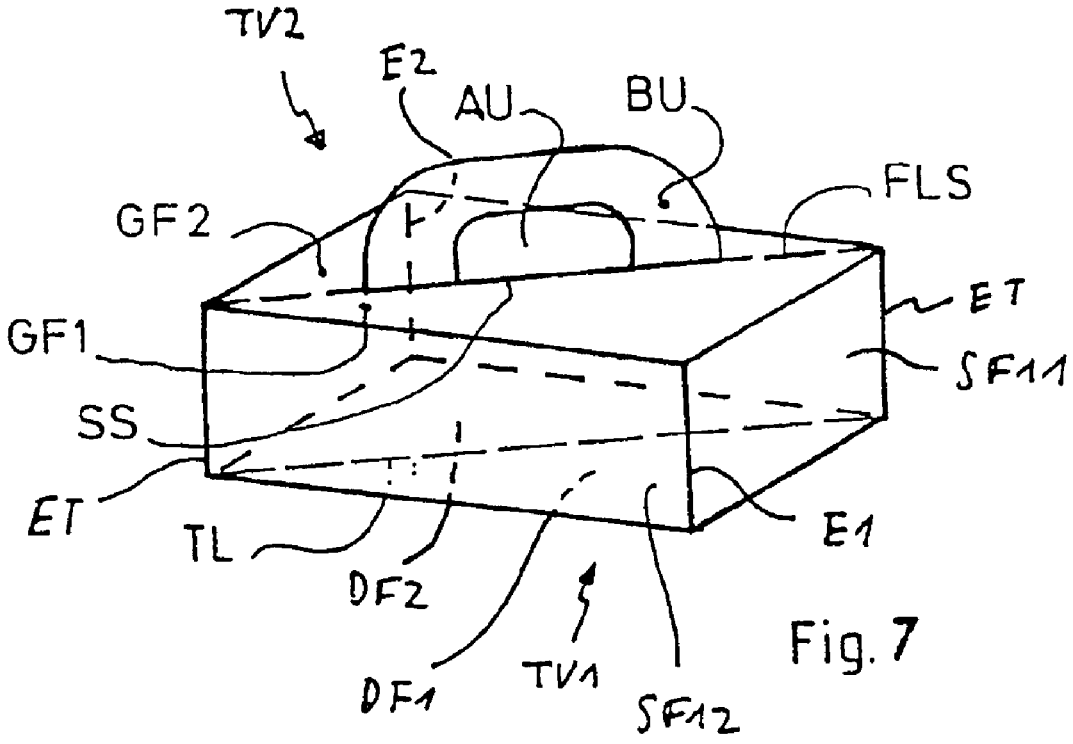
FIG. 7 shows a container with an integrally molded carrying handle.

The container sketched in FIG. 7 is substantially cuboid with a base surface that points upward in the illustration sketched and a lid surface that points downward, and connecting side surfaces, of which the short cuboid side surface SF11 and the long cuboid side surface SF12 of a first part volume TV1 are visible. The lid surface is divided by a dividing surface TL into two part surfaces DF1 and DF2.

Parallel to the dividing line, in the base surface there runs a fold line FLS, which divides the base surface into a part surface GF1 and a part surface GF2. The part volumes TV1 and TV2 can be divided along the dividing line TL and can be pivoted relative to each other along the fold line FLS. Introduced in the course of the fold line FLS is a slot SS, through which, in extension of the part surfaces DF1, DF2, a loop BU with a handle cutout AU is pushed. In FIG. 7, the container is sketched in the first, cuboid position, in which it can be carried conveniently by the carrying loop pushed through. In another position, the carrying loop can be folded into the part volumes so that there is a purely cuboid container that can be stacked easily.

Figure 8:
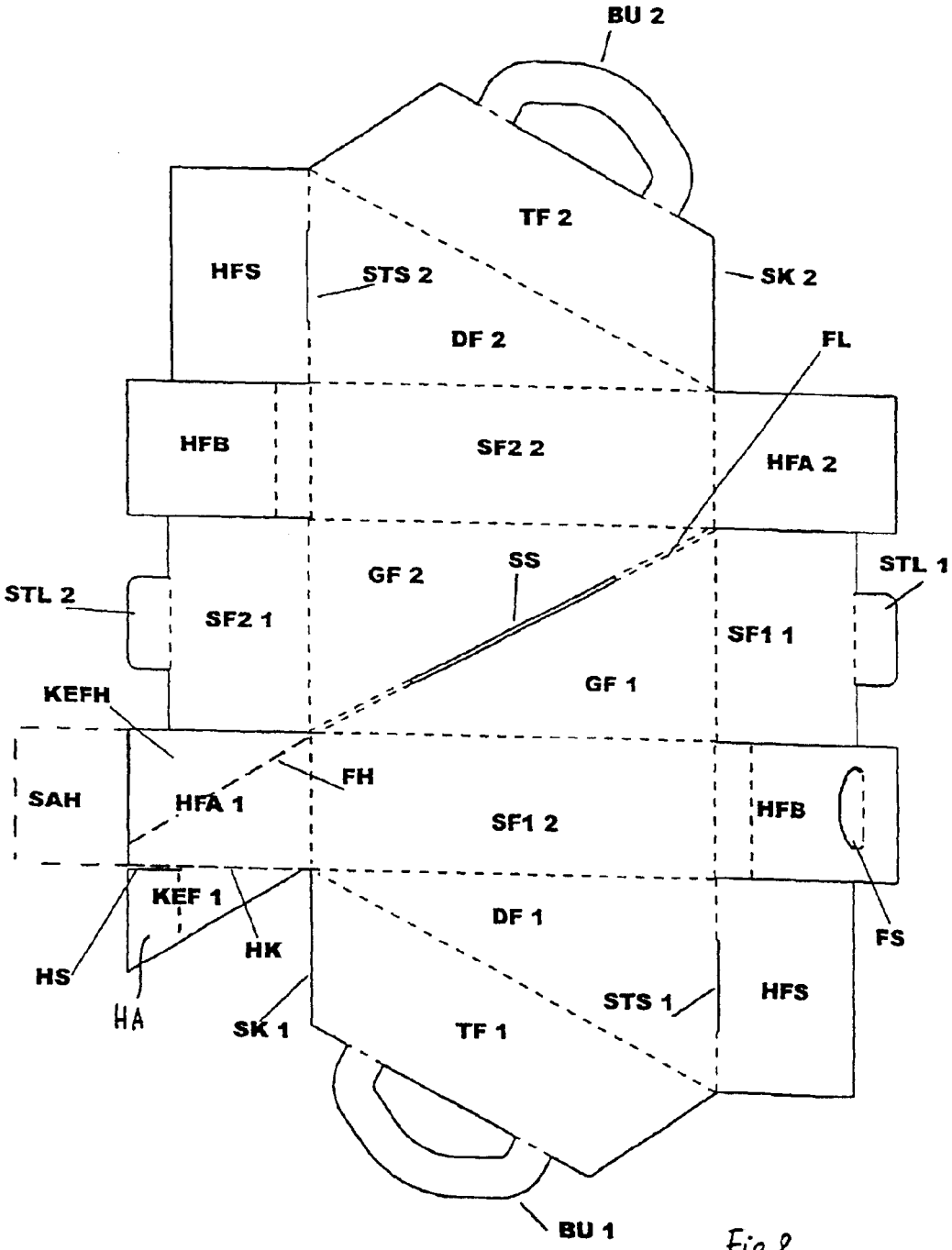
FIG. 8 shows a flat blank related to FIG. 7.

Sketched in FIG. 8 is a flat blank, in particular of cartonboard, which permits a container to be folded up in the manner sketched in FIG. 7, by machine or in particular also by hand. Prepared fold lines are shown by broken lines. In addition to the surfaces which can be seen from the cuboid shape, in particular dividing surface elements TF1 of the first and TF2 of the second part volume are important, continuing along the fold lines from the part surfaces DF1 and DF2 forming the lid surface. In extension of the dividing surface elements TF1, TF2, carrying loops BU1, BU2 are integrally molded. In the base surface, in the fold line which divides the part base surfaces GF1 and GF2 and which is preferably designed as a double fold line, a slot SS is formed, through which the loops BU1, BU2 can be pushed from the inside in order to form the container form sketched in FIG. 7. The loops can also be inserted in a position corresponding to the tabs LA in FIG. 2 and FIG. 3. Auxiliary surfaces HFA1, HFA2, HFB, HFS are advantageous in particular for folding up the container by hand and its stabilization. Integrally molded on the side surfaces SF11, SF21 are plug-in tabs STL1 and STL2 which, inserted into plug-in slots STS1 and STS2, hold together in a simple way the plurality of surfaces bounding the part volumes TV1 and TV2. The surface sections SAH, KEF1 adjoining the auxiliary surface HFA1 can be advantageous for a preferred standing attitude of the container. The auxiliary surfaces HFB can be shaped to form a wedge in the interior of the part volumes. In one of the auxiliary surfaces HFB, a heel supporting tab FS that can be pressed out is prepared.

On one or both part base surfaces, a contact adhesive point, touch and close point or the like can be fixed which, when the part base surface GF2 is placed on the part base surface GF1 in the folded-up state of the second position of the container, detachably holds the base surfaces GF1, GF2 together in this state with a limited holding force without destruction. The same can be provided in the two part surface elements TF1, TF2 on the sides which rest on each other in the cuboid shape, in order to stabilize the cuboid shape of the container further.

Of particular importance is the design of at least one, preferably both, of the part surface elements TF1, TF2 that extend the part surfaces DF1, DF2 in such a way that a supporting edge SK1 and SK2 is formed such that the dividing surface with the supporting edge permits a supporting element for the standing attitude sketched in FIG. 9. In this standing attitude, the short side face of a part volume, for example the side face SF21 of the second part volume TV3, faces a standing surface ST, preferably flat or at least resting on the latter with a longitudinal edge. The second part volume TV2, which, in the plane of the drawing, is shown lying behind the first part volume TV1, can be closed by the dividing surface element TF2.

The first part volume is spaced apart upward from the standing surface and runs downward toward the latter with the oblique side surface SF12, where the corner edge ET(U) can stand on the standing surface. The dividing surface element TF1 has been turned over outward with the integrally molded loop BU1 and placed on the part surface DF1 of the first part volume. Part surface DF1 and loop BU1 are aligned flat with respect to each other.

Figure 9A:
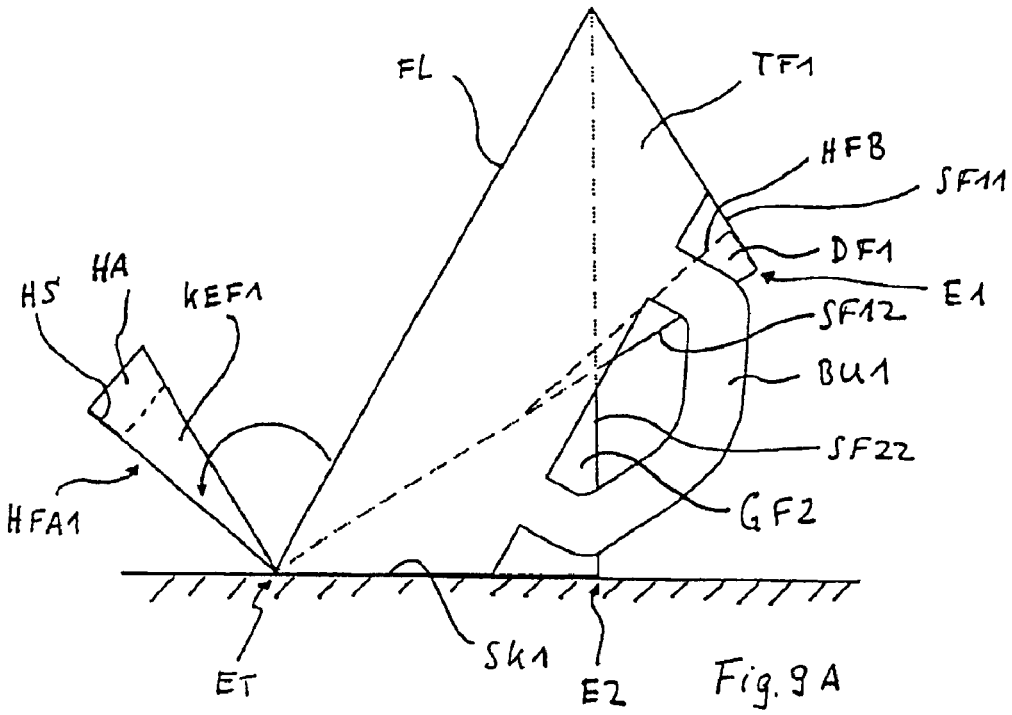
FIG. 9 shows a particularly advantageous standing presentation of a container.
Figure 9B:
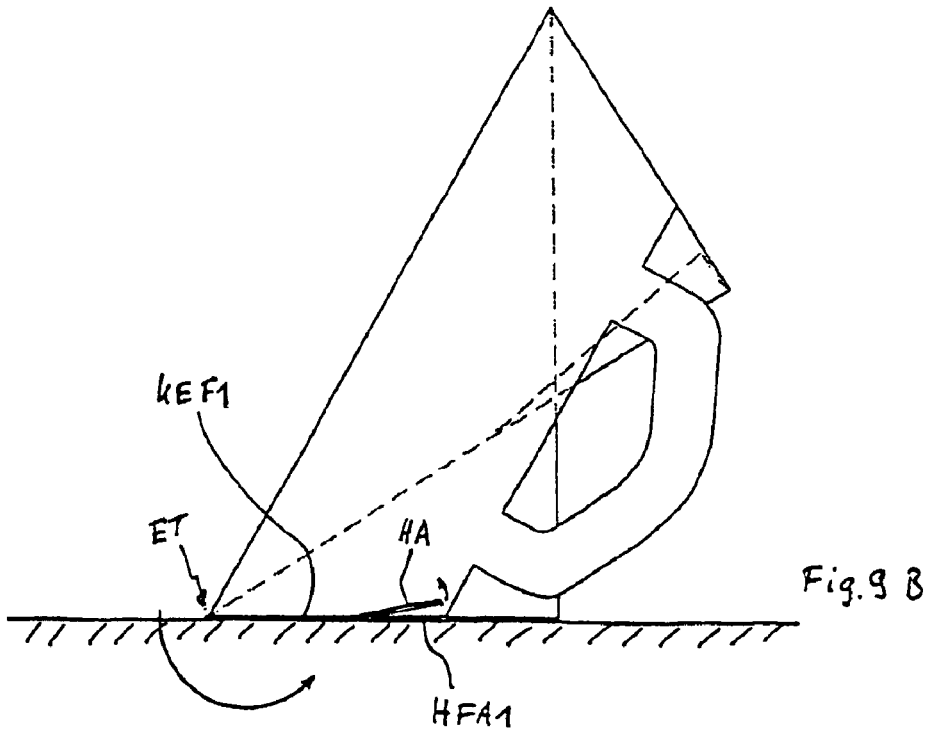

It is important that, in the standing attitude sketched in FIGS. 9A, 9B, the supporting edge SK1 of the dividing surface element TF1 and/or extended tabs LA and/or, with appropriate modification of the loop shape, the loop BU1 stand at least at a point on the standing surface ST, and support the part volume TV1 spaced apart upward from the standing plane at a position that is spaced apart from the second part volume and offset rearward from the lower corner edge ET(U). The support can be linear, as along the supporting edge SK1, approximately point-like, as on the loop BU1, or else flat, in a design not sketched. The area spanned by the short side surface SF21 of the second part volume and the support of the supporting element TF1 with SK1 and/or BU1 encloses the vertical projection of the center of gravity of the entire container together with content, so that in this standing attitude of the second position of the part volumes, the container stands stably and the goods, for example one shoe of a pair, can be presented attractively in the open first part volume TV1. The second part volume can be covered by the dividing surface element TF2, which can then advantageously carry, on its side facing the viewer, a reference to the composition of the goods, to the manufacturer, etc.

Supporting elements with the significant function that the first part volume is supported at a point spaced apart from the second part volume and the front lower edge can feasibly be implemented in a large number of designs. The short side surface of the second part volume preferably rests substantially level and flat on the standing surface, and supporting edge and/or supporting point(s) and/or supporting surface of one or more supporting elements can be placed in a standing plane determined by the short side surface SF21 in the second, folded-up position of the container. For example, for the situation sketched in FIG. 9, in addition to or instead of the support by the supporting edge SK1 and/or the loop BU1, a wedge surface KEFH that can be folded over is also formed in the auxiliary surface HFA1 which adjoins the side surface SF12 in the blank according to FIG. 8 and which, during the cuboid form of the container, runs along the dividing surface or rests on the inside of the side surface SF12, the auxiliary surface HFA1 being folded over under the first part volume in the folded-up second position of the container, and the wedge surface being folded up around the fold line FH to form a vertical supporting wedge under the long side surface SF12 which runs obliquely. A wedge surface of this type can also be formed by a wedge surface that can be folded over and adjoins the auxiliary surface HFA1 laterally. In yet another design, the auxiliary surface HFA1 can be lengthened away from the side surface SF12 by a further section SAH which can be folded over and which, after the auxiliary surface HFA1 has been folded over under the side surface SF12, is folded up in the direction of this side surface SF12 as a vertical or oblique support. A surface section folded up from the auxiliary surface HFA1 in the direction of the side surface SF12 can be secured by being inserted into a slot or a cutout in the side surface SF12.

Particularly advantageous is an embodiment with a lateral extension surface on the auxiliary surface HFA1, for example in the form of a wedge surface KEF1, whose connecting edge HK with the auxiliary surface has a slot HS from one side, preferably at a position spaced apart from the side surface SF12. The extension surface and the auxiliary surface are turned over rearward and downward when the container is opened for the standing position according to FIG. 9A and are positioned flat with the connecting edge and the slot under the supporting edge of the dividing surface element TF1. As a result of a rear section HA of the extension surface being bent over slightly in the region of the slot HS, as in FIG. 9B, the slotted edge rests in a slightly clamping manner on the folded-up dividing surface element TF1 and holds TF1 reliably in the position resting on the lid surface DF1. An intermediate position when folding out auxiliary surface HFA1 with extension surface SF, the latter, folded over against the auxiliary surface HFA1 in the closed container state, can rest on the lid surface DF1, is shown in FIG. 9A.

Instead of the container with a blank according to FIG. 8, which can be folded up by hand and broken down again without destruction, it is of course also possible for a container with a different flat blank, which is to be folded up and/or adhesively bonded by a machine, to be provided.

Figure 10:
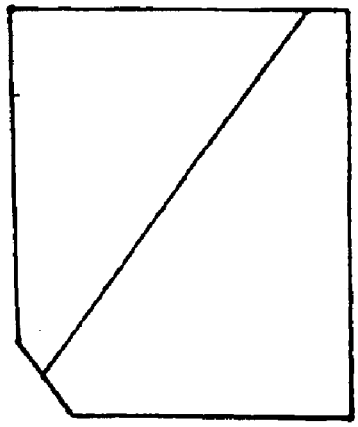
FIG. 10 shows a container form with a not exactly rectangular outline.

The outline of the container, given by the lid surface and base surface, is not necessarily exactly rectangular, and the dividing surface is not absolutely exactly diagonal. FIG. 10 shows an example of an outline with at least one beveled corner and a dividing surface not guided exactly diagonally. The flat blank also possible for such forms is, however, more complex in terms of folding.

Further variants for the construction of supporting elements for the above-described function of supporting the first part volume in a standing attitude corresponding to FIG. 9 are possible. A particularly advantageous embodiment is sketched in FIG. 11 to FIG. 14.

Figure 11:
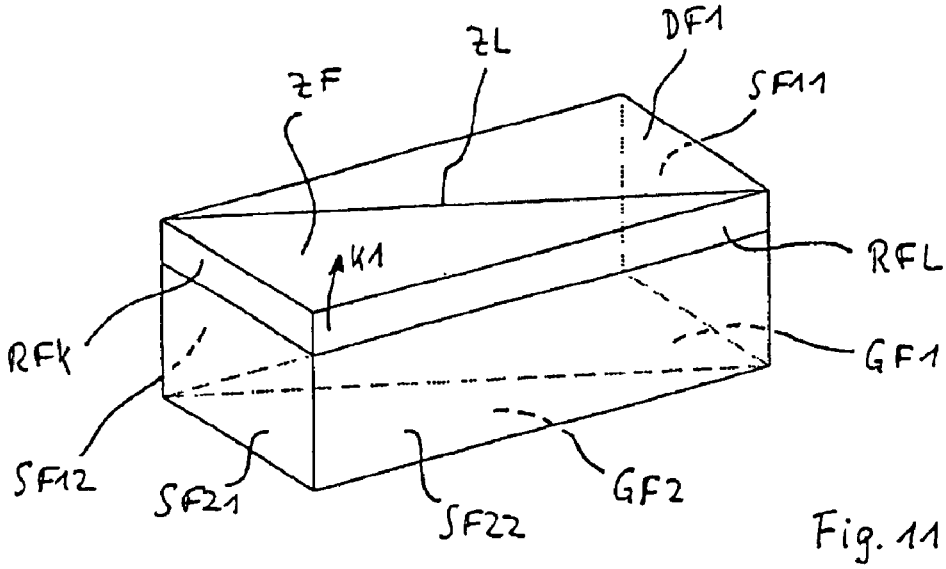
FIG. 11 shows a preferred embodiment in cuboid form.

FIG. 11 shows a container in oblique view. Corresponding to the embodiment already described, the container has as the container envelope a cuboid form, whose rectangular base surface is divided by a fold line FL into two part surfaces GF1 and GF2. By being folded along the fold line FL, the container can be divided into two part volumes which cohere along the fold line and which each have the triangular part base surfaces GF1 and GF2 as outline. The part volumes, facing away from the base surface, are closed off by appropriate triangular lid surfaces DF1 and DF2. The part lid surface DF2 which is opposite the part base surface GF2 is invisible in the position of the container according to FIG. 11.

The part lid surface DF1 continues along a further fold line ZL which, in the projection at right angles to the lid surface, coincides with the dividing line TL hidden underneath it, in an additional surface TF, which covers the second part lid surface DF2 and is substantially equal to the latter in size and shape. Along its outer edges, facing away from the additional fold line ZL, the additional surface ZF has edge folds RFL, RFK which project at right angles to the plane of the surface and engage around the outer edges of the lid surface DF2 in the position sketched in FIG. 11. In this position of the container, the edge folds can be used in particular to hold the additional surface ZF reliably and in a simple way in the position parallel to the lid surface DF2 by engaging around and slightly clamping the second part volume along the outer edges of the part surface DF2.

Figure 12:
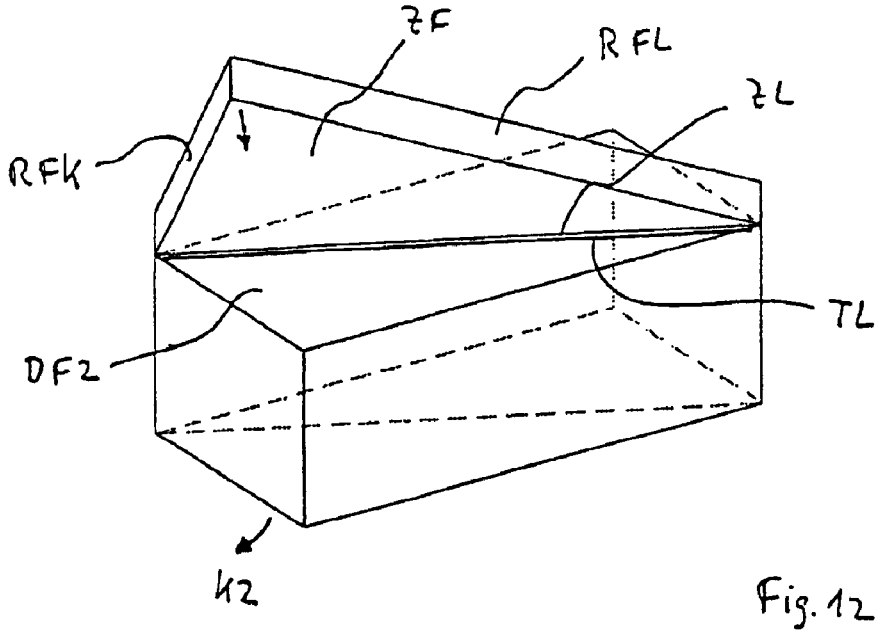
FIG. 12 shows the container according to FIG. 11 with the additional surface partly folded up.

The additional surface ZF with the edge folds can be raised off the second lid surface DF2, out of the position sketched in FIG. 11, by being pivoted in the direction of arrow K1 about the additional fold line ZL, and pivoted through 180° to such an extent that the additional surface ZF rests on the first lid surface DF1 of the first part volume. FIG. 12 shows an intermediate position, in which the additional surface ZF has been folded up by about ¾ of its maximum pivoting movement and, and the same time, the dividing line TL also becomes visible.

The two part volumes can be folded away from each other in the manner described by being pivoted about the fold line FL in the base surface in the direction of arrow K2, the corner edges ET1, ET2 previously resting on each other being separated. This pivoting movement K2 is also carried out with a pivoting angle of 180°, so that the part surfaces GF1, GF2 of the base surface rest on each other in the folded-up state. In this folded-up state, the corner edges ET1, ET2 of the two part volumes run in alignment with each other in extension. In the projection at right angles to the base and lid surfaces, in the fully folded-up state, the additional surface ZF, the base part surface GF2 and the lid part surface DF2 are again aligned congruently. In particular, the short RFK of the two edge folds and the narrow cuboid side SF11 lie substantially in one plane. The second part volume lies between the additional surface ZF and the first part volume. The container can therefore be stood up on a standing surface ST in a manner corresponding to FIG. 8, such that the short side surface SF21 of the second part volume and the short edge fold TFK stand up on the standing plane ST. The long side surface SF12 of the first part volume then runs at an angle with respect to the horizontal and, as shown by a broken line in side view in FIG. 14, can present a shoe as goods WA in oblique position, for example held by the heel of the shoe butting up against a step fold FS. In this presentation position, the second part volume can remain closed by a further extension surface TF2 which, connected to the part surface DF2 along the dividing line TL, can be inserted or pushed through at the fold line FL, as described per se in the main patent. The further extension surface TF2 can stabilize the folded-up container against lateral shear forces in the closed position according to FIG. 13, in which a second shoe of a pair is hidden in the second part volume.

The edge folds RFK, RFL, in this completely folded-up position, serve primarily to stabilize the additional surface ZF which forms the lateral support, facing away from the second part volume, for the first part volume. In the region of the edge folds RFL, RFK, further cartonboard sections that can also be folded out again can beneficially be contained which, by being folded over and plugged on to the further fold line ZL, hold the additional surface pivoted through 180° with respect to the part surface DF1 in this pivoted position. Other holding means such as adhesive points or touch and close points at corresponding locations on part surface DF2 and additional surface ZF have intrinsically already been mentioned and/or are known. Such holding elements may also in principle hold the additional surface ZF in the closed position sketched in FIG. 11.

Figure 13:
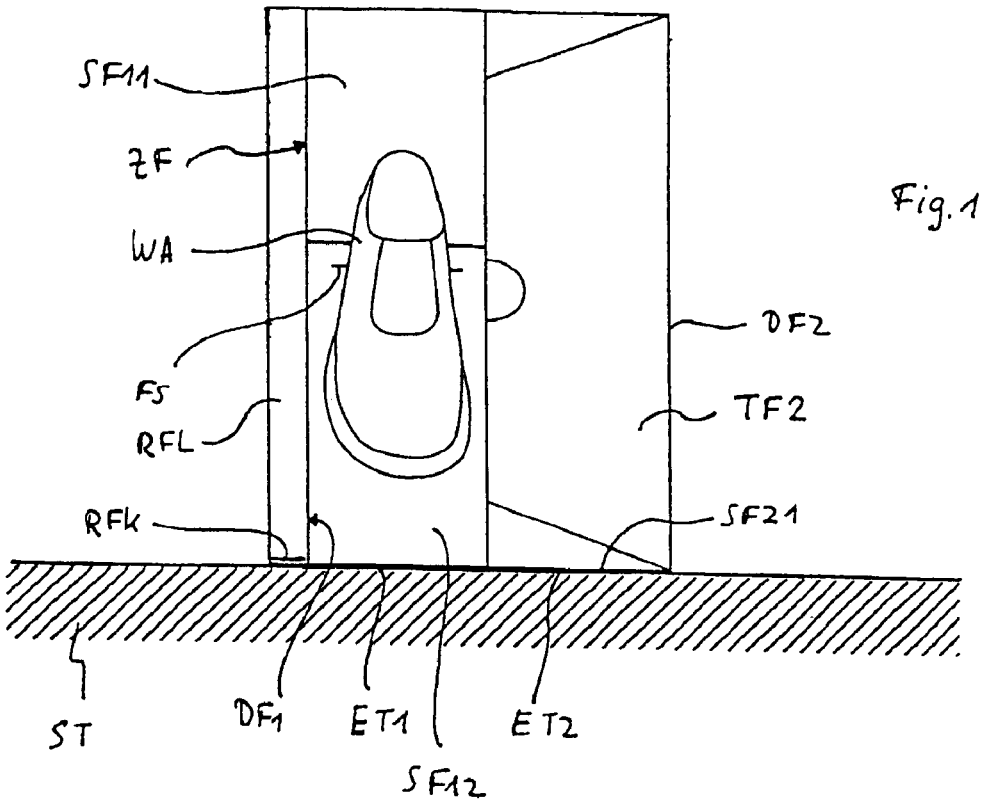
FIG. 13 shows the container standing up, in front view.
Figure 14:
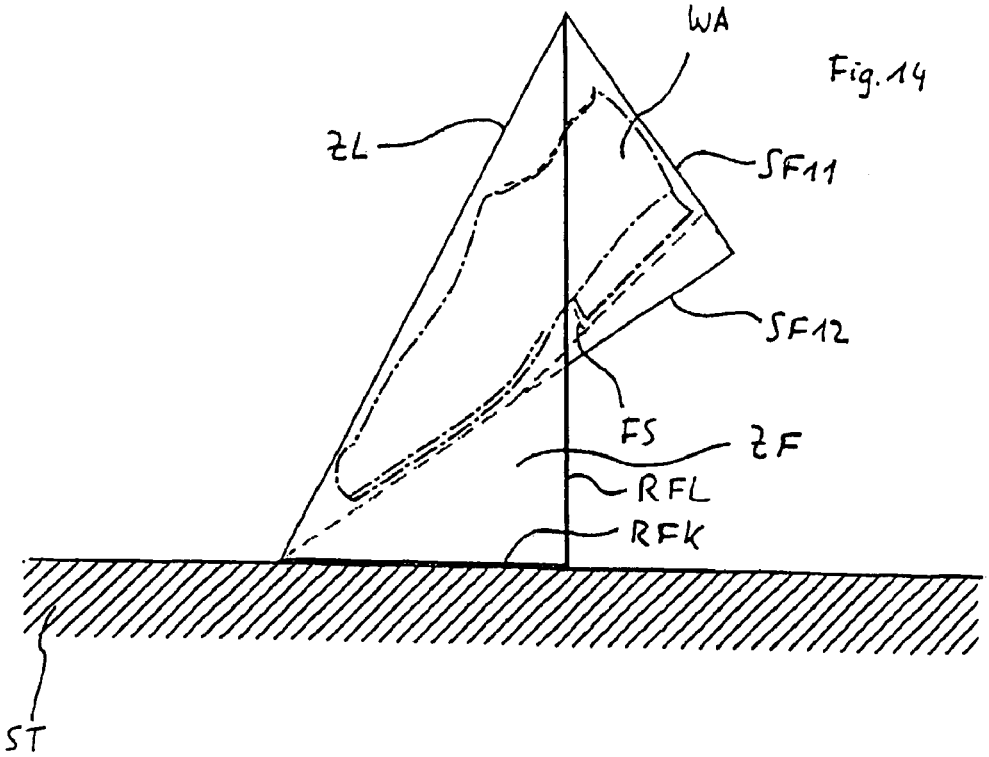
FIG. 14 shows the container standing up, in side view.

In the folded-up position in FIG. 13 and FIG. 14, containers according to the invention can also advantageously be stood up pushed close to one another such that, in the illustration according to FIG. 13, further containers adjoin on the left and/or right in such a way that the part lid surface DF2 of a container rests on the additional surface ZF of the immediately adjacent container and is clasped at the rear and bottom by its edge folds.

The above features and those specified in the claims and which can be gathered from the figures can advantageously be implemented both individually and in various combinations. The invention is not restricted to the exemplary embodiment described, but can be modified in various ways within the scope of the knowledge of those skilled in the art. In particular, in addition to the sketched examples for planar cross sections that can be folded up, other solutions are possible. In the folded-up container, part surfaces can also be connected nondetachably, for example adhesively bonded or stapled. Courses of fold lines, dividing lines, dividing surfaces, differing from the sketched examples, of a large range of variations are accessible within the scope of the invention.

What is claimed is:

1. A container having a container volume comprising a first partial volume and a second partial volume, and at least one supporting element, said container having a first position and a second position;

wherein in said first position, said first partial volume and said second partial volume meet along a dividing surface to form a substantially cuboid body comprising a lid surface, a base surface parallel to said lid surface, and side walls connected to said lid surface and said base surface, said dividing surface intersecting said base surface at least approximately diagonally along a first fold line and said interesting lid surface along a dividing line to divide said base surface and said lid surface into first and second partial base surfaces and first and second partial lid surfaces, respectively;

wherein said first partial volume and said second partial volume are dividable along said dividing line and are connected to each other along said first fold line in an articulated manner to permit pivoting of said first and second partial volumes;

wherein, upon being pivoted about said first fold line, said first partial volume and said second partial volume are brought into the second position wherein said first and second partial base surfaces are opposite each other; and wherein in the second position when the container is set up, said second partial volume has a short side surface and a standing surface facing said short side surface and said at least one supporting element is disposed in said short side surface and forms a standing plane with said first partial volume and supports said first partial volume at a location spaced from said second partial volume.

2. The container as claimed in claim 1, wherein in said first position, said second partial volume has a short cuboid edge and said at least one supporting element has a supporting edge that is parallel to said short cuboid edge.

3. The container as claimed in claim 1, wherein said at least one supporting element is connected to the first partial volume and can be pivoted relative to said first partial volume.

4. The container as claimed in claim 1, wherein said at least one supporting element comprises an extension of said first partial lid surface of the first partial volume.

5. The container as claimed in claim 4, wherein said first partial lid surface comprises an additional extension surface, said additional extension surface in the first position of the container being pivotable about a second fold line substantially coincident with the dividing line to cover the second partial lid surface, said additional extension surface in the second position of the container, resting on the first partial lid surface to form said at least one supporting element.

6. The container as claimed in claim 5, further comprising edge folds projecting at the edges of the additional extension surface, at right angles to the plane of the surface, said edge folds in the first position of the container, engaging around the outer edges of the second partial lid surface.

7. The container as claimed in claim 4, wherein said at least one supporting element is formed by an extension surface of the first partial lid surface, which can cover the second partial volume at right angles to the first partial surface.

8. The container as claimed in claim 1, wherein said at least one supporting element can be aligned parallel to the first partial lid surface the first partial volume.

9. The container as claimed in claim 1, wherein the partial volumes are shaped identically and, in the first position, are arranged axially symmetrically in relation to each another with respect to a mid-axis of the body.

10. The container as claimed in claim 1, wherein at least one of the first and second positions of the partial volumes is stabilized by elements of the container.

11. The container as claimed in claim 1, wherein the partial lid surfaces continue in the dividing surface and cover the partial volumes separately.

12. The container as claimed in claim 1, wherein the partial lid surfaces continue toward the base surface in the form of plug-in tabs, and the plug-in tabs project through the base surface.

13. The container as claimed in claim 12, wherein the sections of the tabs that project through the base surface are shaped as grip loops.

14. The container as claimed in claim 1, wherein the fold line meets the side edges of the base surface at an angle of at most 75°.

15. The container as claimed in claim 14 wherein said angle is at most 60°.

16. The container as claimed in claim 1, wherein the direction of the fold line is offset at an angle of at most 15° with respect to the direction of the surface diagonal of the base surface.

17. The container as claimed in claim 1, wherein the container can be constructed by folding from a flat blank.

18. The container as claimed in claim 1, wherein the container is made from cartonboard.

19. The container as claimed in claim 1, wherein the container forms a presentation structure with a short side surface of the second partial volume, facing a standing surface, and supported with respect to the standing surface on sides of the first partial volume by the at least one supporting element.

* * * * *

UNITED STATES PATENT AND TRADEMARK OFFICE

CERTIFICATE OF CORRECTION

PATENT NO. : 6,905,027 B2
DATED : June 14, 2005
INVENTOR(S) : Galter

It is certified that error appears in the above-identified patent and that said Letters Patent is hereby corrected as shown below:

Column 10,
Line 2, after the word "and" please change "said interesting" to correctly read:
-- intersecting said --.
Line 41, after the word "container" please delete ",".
Line 55, after the word "surface" please insert the word -- of --.

Signed and Sealed this

Thirtieth Day of August, 2005

JON W. DUDAS
*Director of the United States Patent and Trademark Office*